United States Patent [19]

Takahashi

[11] Patent Number: 4,488,526

[45] Date of Patent: Dec. 18, 1984

[54] FUEL INJECTION PUMP FOR INTERNAL COMBUSTION ENGINE

[75] Inventor: Ikuo Takahashi, Katsuta, Japan

[73] Assignee: Hitachi, Ltd., Tokyo, Japan

[21] Appl. No.: 423,445

[22] Filed: Sep. 24, 1982

[30] Foreign Application Priority Data

Sep. 28, 1981 [JP] Japan ..... 56/152185

[51] Int. Cl.[3] ..... F02M 59/42

[52] U.S. Cl. ..... 123/357; 123/450; 123/458; 417/387

[58] Field of Search ..... 123/450, 458, 357, 501, 123/494; 417/386, 387, 462

[56] References Cited

U.S. PATENT DOCUMENTS

| | | | |
|---|---|---|---|
| 3,035,523 | 5/1962 | Kemp et al. | 417/386 |
| 3,107,661 | 10/1963 | Kemp | 417/462 |
| 3,500,749 | 3/1970 | Kemp et al. | 417/386 |
| 3,851,635 | 12/1974 | Murtin et al. | 123/458 |
| 4,377,139 | 3/1983 | Jarrete et al. | 123/450 |

FOREIGN PATENT DOCUMENTS

| | | | |
|---|---|---|---|
| 246055 | 1/1963 | Australia | 123/450 |
| 59943 | 9/1982 | European Pat. Off. | 123/450 |
| 1919969 | 11/1970 | Fed. Rep. of Germany . | |
| 3004460 | 9/1981 | Fed. Rep. of Germany . | |
| 1210234 | 10/1970 | United Kingdom . | |
| 2017205 | 10/1979 | United Kingdom . | |
| 2067680 | 7/1981 | United Kingdom | 123/450 |

*Primary Examiner*—Magdalen Y. C. Moy

*Attorney, Agent, or Firm*—Antonelli, Terry & Wands

[57] ABSTRACT

A fuel injection pump for an internal combustion engine including a rotor located in a housing, a free piston movably mounted in an axial bore in the rotor, two pressure chambers defined by an inner wall surface of the axial bore in the rotor the free piston, and two solenoid valves for supplying fuel to the pressure chambers and a sensor for sensing a displacement of the free piston in an axial direction.

3 Claims, 6 Drawing Figures

FUEL INJECTION PUMP FOR INTERNAL COMBUSTION ENGINE

BACKGROUND OF THE INVENTION

This invention relates to fuel injection pumps for internal combustion engines capable of effecting control of the amount of fuel injected and the injection timing, and, more particularly, to a fuel injection pump for an internal combustion engine comprising a rotor located in a housing, a free piston movably mounted in an axial bore in the rotor, two pressure chambers defined by an inner wall surface of the axial bore in the rotor and the free piston, and two solenoid valves for supplying fuel to the two pressure chambers.

Fuel injection pumps are used for feeding fuel at high pressure into the interior of internal combustion engines. In recent years, a demand has been created for relying on electronic control for effecting control of the amount of the fuel injected and the injection timing of a fuel injection pump. A device of this type is shown, for example, in U.S. Pat. No. 4,185,779.

In the fuel injection pump incorporating therein the control device of this type, control of the amount of the fuel injected and the injection timing are effected by feedback control utilizing the servomechanism. The device of this type is complex in construction and high in cost.

In, for example, commonly assigned U.S. Application Ser. No. 304,359, and now U.S. Pat. No. 4,445,822 a fuel injection pump capable of readily controlling both the amount of the fuel injected and the injection timing is described wherein the fuel injection pump comprises a rotor located in a cylindrical housing, a free piston movably mounted in an axial bore in the rotor, two pressure chambers defined by an inner wall surface of the axial bore in the rotor and the free piston, and two solenoid valves for supplying fuel to the two pressure chambers. One of the two pressure chambers receives therein the fuel to be injected and the other pressure chamber receives therein the fuel for effecting control of the injection timing. The two pressure chambers are separated from each other by the movable free piston.

The fuel injection pump described hereinabove is capable of readily controlling the amount of the fuel injected and the injection timing by virture of the aforesaid construction. However, a lack of means for sensing the amount of fuel drawn by suction to be injected and the timing for compressing the fuel to be injected, it has been impossible to directly detect abnormal conditions of the fuel injection pump, such as trouble of the solenoid valves.

SUMMARY OF THE INVENTION

An object of this invention is to provide a fuel injection pump for an internal combustion engine capable of sensing the amount of fuel fed into the pressure chamber for the fuel to be injected and the timing for compressing the fuel to be injected.

Another object is to provide a fuel injection pump for an internal combustion engine capable of controlling the amount of injection fuel and the timing of injection by controlling the solenoid valves for fuel supply by utilizing signals generated by sensing the amount of fuel to be injected supplied to the pressure chamber and the timing of compression of the fuel to be injected.

To accomplish the aforesaid objects, the invention provides, in a fuel injection pump for an internal combustion engine comprising a rotor located in a housing, a free piston movably mounted in an axial bore in the rotor, two pressure chambers defined by an inner wall surface of the axial bore in the rotor and the free piston and two solenoid valves for supplying fuel to the two pressure chambers, means for sensing a displacement of the free piston in an axial direction.

Preferably, the means for sensing the axial displacement of the free piston comprises contactless displacement sensing means, and it is particularly advantageous in processing displacement signals to convert the displacements of the free piston to electrical physical amounts, such as changes in inductance or capacitance.

An optimum displacement sensing means would sense a displacement of the free piston as a change in the inductance of a coil. Such displacement sensing means would comprise a displacement sensing coil having its inductance varied by an axial displacement of the free piston, a holding rod for affixing the displacement sensing coil, a thrust ring rotatably fitted between the inner wall surface of the axial bore in the rotor and an outer peripheral surface of the holding rod, and a member secured to the rotor for preventing an axial movement of the thrust ring.

To control the amount of the fuel to be injected and the timing of injection by utilizing a signal generated by sensing a displacement of the free piston, the fuel injection pump of an internal combustion engine according to the invention may be further provided with a control circuit for effecting control of the solenoid valves for feeding fuel into the pressure chambers.

DETAILED DESCRIPTION OF THE PREFERRED EMBODIMENT

Figure 1:
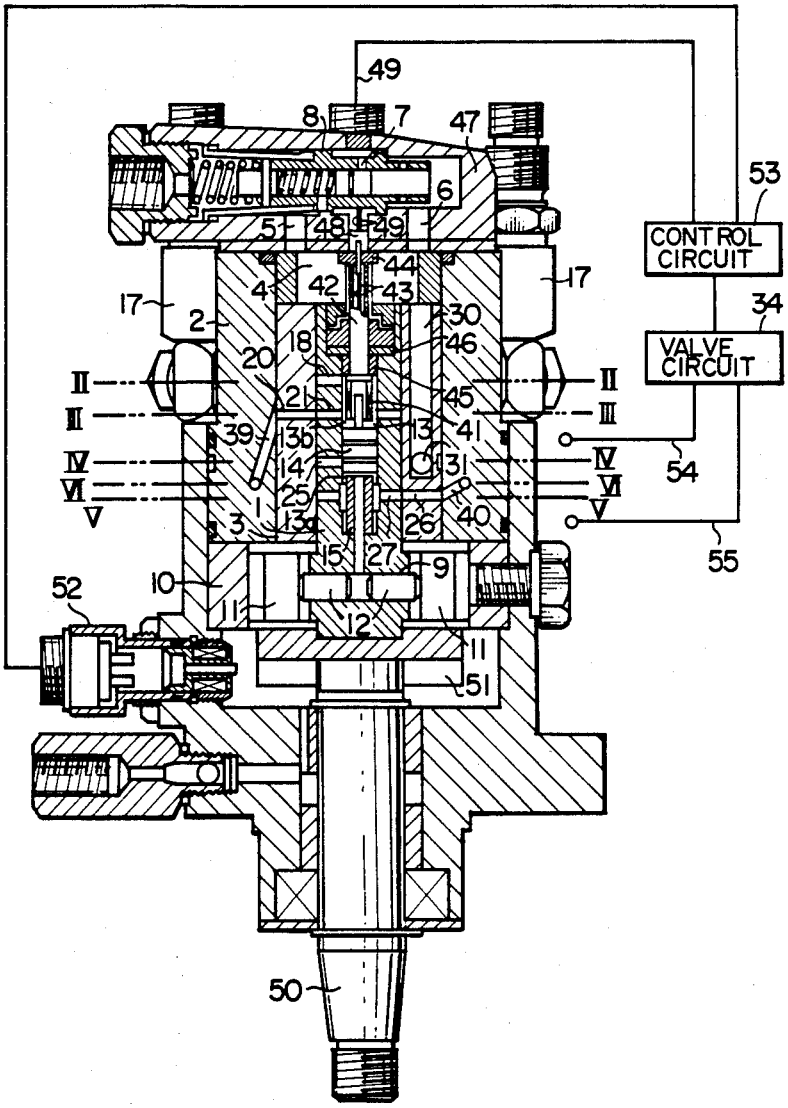
FIG. 1 is a vertical sectional view of the fuel injection pump for an internal combustion engine comprising one embodiment of the invention.

Referring now to the drawings wherein like reference numerals are used throughout the various views to designate like parts and, more particularly, to FIG. 1, according to this Figure, a rotor 1 is rotatably mounted in a sleeve 3 fitted in a housing 2 of a cylindrical shape and has a pressure generating section at one end thereof for producing a pressure by means of plungers and a rotary section of a vane type feed pump 4 at the other end thereof. The feed pump 4 has an inlet 5 and an outlet 6 formed in the casing 2, with the inlet 5 being connected to a fuel source during operation. The inlet 5 and the outlet 6 are connected together through a communicating bore 7 which is opened and closed by a spring-loaded valve member 8 to adjust the pressure at the outlet 6.

The pressure generating section is formed with a transverse bore 9 having inserted therein a pair of slidable plungers 12 capable of moving inwardly through rollers 11 by the profile of an annular cam 10 mounted in the casing 2 while the rotor 1 is rotating. The transverse bore 9 is connected to one end of an axial passageway 13 formed in the rotor 1 for mounting a free piston 14 for sliding movement. The allowable distance covered by the movement of the free piston 14 is decided by a stopper 15 spaced apart from the free piston 14.

The axial passageway 13 is partitioned by the free piston 14 into two pressure chambers 13*a* and 13*b*. The first pressure chamber 13*a* located below the free piston 14 has fuel fed thereto for controlling the timing of injection, and the second pressure chamber 13*b* located above the free piston 14, has fuel to be injected fed thereto.

Figure 2:
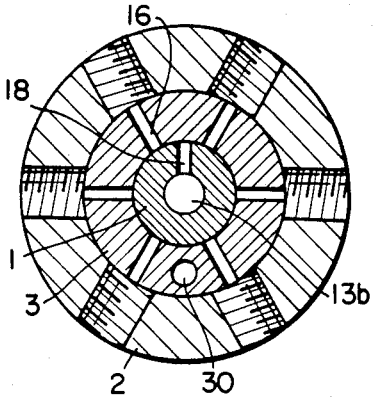
FIG. 2 is a sectional view taken along the line II—II in FIG. 1.
Figure 3:
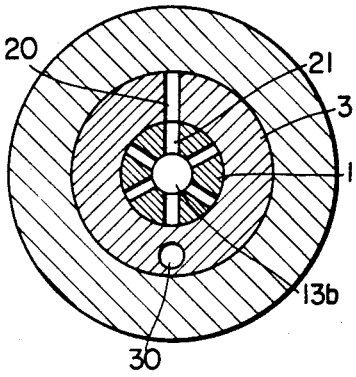
FIG. 3 is a sectional view taken along the line III—III in FIG. 1.

As shown in FIG. 2, a discharge passage 18 is formed in the rotor 1 on the second pressure chamber 13*b* side, and the sleeve 3 is formed with a plurality of equiangularly-spaced-apart output passages 16. While the rotor 1 is rotating, the discharge passage 18 is brought into communication with one output passage 16 after another, and the output passages 16 are connected through a pressure valve 17 (see FIG. 1) to respective cylinders of the internal combustion engine. The embodiment of the invention shown and described hereinabove is intended for a 6-cylinder internal combustion engine and has six output passages 16. As shown in FIG. 3, the rotor 1 is formed with second radial passages 21 equal in number to the output passages 16 which are equiangularly located, and the sleeve 3 is formed with a second stationary passage 20 which is brought into communication with one second radial passage 21 after another while the rotor 1 is rotating. All these passages are arranged in such a manner that the second stationary passage 20 is brought into communication with one of the second radial passages 21 when at least the discharge passage 18 does not communicate with one of the output passages 16.

Figure 4:
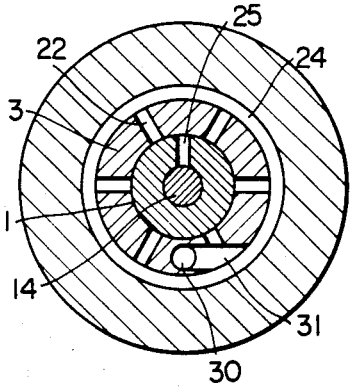
FIG. 4 is a sectional view taken along the line IV—IV in FIG. 1.
Figure 5:
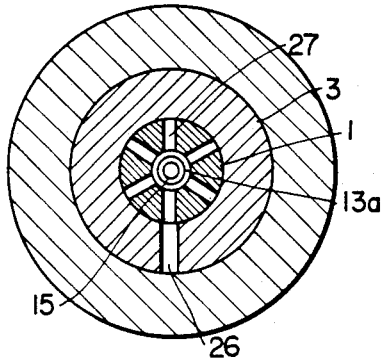
FIG. 5 is a sectional view taken along the line V—V in FIG. 1.

Referring to FIG. 4 a spill port 25 is formed in the rotor 1 on the first pressure chamber 13*a* side, and the sleeve 3 is formed with spill passages 22 equal in number to the output passages 16 which are equiangularly spaced apart from one another. When the free piston 14 is in a lower position, the spill port 25 is closed by the free piston 14. However, when the free piston 14 is in an upper position, the spill port 25 is brought into communication with the first pressure chamber 13*a*, and the spill port 25 is brought into communication with one spill passage 22 after another while the rotor 1 is rotating. The spill passages 22 further communicate with the collecting groove 24. As shown in FIG. 5, the rotor 1 is formed with first radial passages 27 equal in number to the output passages 16 which are equiangularly spaced apart from one another, and the sleeve 3 is formed with a first stationary passage 26 which is brought into communication with one first radial passage 27 after another while the rotor 1 is rotating. All these passages are constructed in such a manner that communication between the spill port 25 and one of the spill passages 22 takes place when at least the discharge passage 18 communicates with one of the output passages 16 and communication between the first stationary passage 26 and one of the first radial passages 27 takes place when at least the discharge passage 18 and one of the output passages 16 do not communicate with each other.

Figure 6:
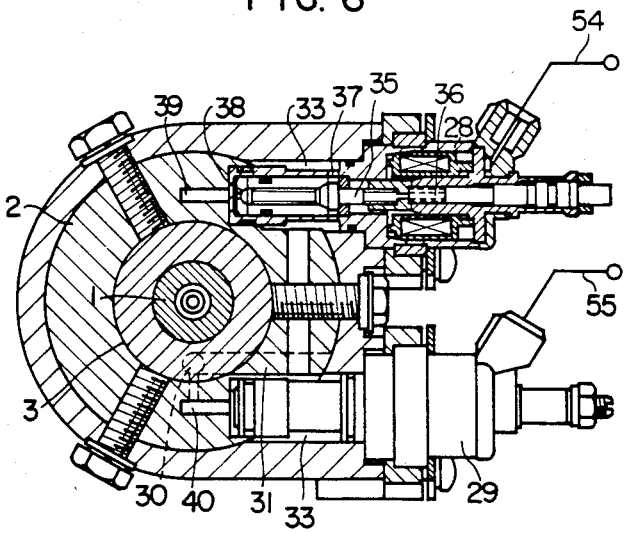
FIG. 6 is a sectional view taken along the line VI—VI in FIG. 1.

As shown in FIG. 1 and FIG. 6 the casing 2 has mounted thereon a solenoid valve 28 for feeding fuel to be injected and a solenoid valve 29 for feeding fuel for controlling the injection timing. The outlet 6 is maintained in communication at all times with the solenoid valves 28 and 29 and a suction space 33 of a mounting section through an outlet passage 30, a transverse bore 31 and a vertical bore, not shown, formed in the sleeve 3.

The solenoid valves 28 and 29 are actuated by an electric current generated by a valve drive circuit 34 located separately from the injection pump. When the solenoid valve 28 is energized and a needle valve 35 moves to the right in FIG. 6 against the biasing force of a return spring 36, fuel in the suction space 33 that has had its pressure adjusted is introduced through a valve opening 37 and released through a throttle port 38. The throttle port 38 of the solenoid valve 28 is connected to the second stationary passage 20 via an injection bore 39, and the throttle port of the solenoid valve 29 is connected to the first stationary passage 26 via a timing bore 40. The solenoid valve 29 is identical with the solenoid valve 28 in construction, so that parts of the former corresponding to those of the latter are not shown.

Referring to FIG. 1 again, a displacement sensing coil 41 having its inductance varied as the free piston 14 changes its position is mounted in the axial passageway 13 and affixed to a holding rod 42. Leads 43 of the coil 41 are fixed into the holding rod 42 in intimate contact therewith and connected at the forward ends to a terminal 44 secured to the holding rod 42.

A thrust ring 45 rotatably fitted between the inner wall surface of the axial passageway 13 and the holding rod 42 is interposed between a flange of the holding rod 42 and a stopper member 46 secured to the rotor 1, so as to be kept from moving axially. The holding rod 42 is kept from moving axially by a flange of the terminal 44.

A fuel pressure adjusting section 47 has a terminal 48 which corresponds to the terminal 44 and takes out a signal from the displacement sensing coil 41 through conductors 49. The terminals 44 and 48 are provided with means for preventing from its rotation, so that the holding rod 42 unitary with the terminal 44 is kept from rotating.

A drive shaft 50, driven in timed relation to an internal combustion engine, not shown, is connected to the rotor 1 through a coupling 51 formed at its peripheral surface with projections equal in number to the cylinders of the internal combustion engine. The casing 2 has secured thereto a position sensor 52 which generates signals varying depending on whether the projections are near thereto or remote therefrom.

An output signal of the displacement sensing coil 41 is inputted to a control circuit 53 through the conductors 49, and an output signal of a position sensor 52 is also inputted to the control circuit 53. The control circuit 53 generates a control voltage corresponding to the control characteristic of the internal combustion engine by using these input signals as signals including operating condition. The control voltage generated by the control circuit 53 is inputted to a valve drive circuit 34 which actuates the solenoid valves 28 and 29 in accordance with the control voltage signal inputted thereto.

Operation of the embodiment shown and described hereinabove will now be described. With the free piston 14 in the upper position, the second stationary passage 20 communicates with one of the second radial passages 21 in a certain rotational position of the rotor 1 while the first stationary passage 26 communicates with one of the first radial passages 27.

The fuel to be injected into the internal combustion engine at this time will first be described. The control circuit 53 generates a control voltage upon receipt of a signal from the position sensor 52, and the valve drive circuit 34 receiving this voltage signal actuates the solenoid valve 28. Upon energization of the solenoid valve 28, the needle valve 35 moves to the right to feed the fuel in the suction space 33 through the valve opening 37, the throttle port 38 and the injection bore 39 into the second stationary passage 20 from which the fuel flows through the second radial passage 21 into the second pressure chamber 13*b*. The fuel fed into the second pressure chamber 13*b* moves the free piston 14 downwardly and at the same time causes the plungers 12 to shift outwardly. At this time, the distance covered by the downward movement of the free piston 14 is sensed by the displacement sensing coil 41 which generates a signal inputted to the control circuit 53.

The fuel for deciding the timing of injection will now be described. The control circuit 52 generates a control voltage upon receipt of a signal from the position sensor 52, and the valve drive circuit 34 receiving this voltage signal actuates the solenoid valve 29. Upon energization of the solenoid valve 29, the needle valve 35 moves to the right and the fuel in the suction space 33 is fed through the valve opening 37, the throttle port 38 and the timing bore 40 into the first stationary passage 26 from which the fuel flows through the first radial passage 27 into the first pressure chamber 13*a*. From the first pressure chamber 13*a*, the fuel is led into the transverse bore 9.

The timing for initiating fuel injection into the internal combustion engine varies depending on the amount of fuel led into the transverse bore 9. The greater the amount of fuel led into the transverse bore 9, the larger is the distance the plungers 12 shift outwardly. If the rotor 1 is rotating, then the plungers 12 are shifted inwardly by the annular cam 10 at an earlier time, so that the injection timing is earlier.

Further rotation of the rotor 1 brings the discharge passage 18 into communication with one of the output passages 16 and the spill port 25 into communication with one of the spill passages 22. Delivery of the fuel will now be described. If the rotor 1 is rotating, then the plungers 12 are made to shift inwardly by the annular cam 10 and the free piston 14 is moved upwardly by the pressure of the fuel generated in the first pressure chamber 13*a*, so that the fuel is injected from the second pressure chamber 13*b* through the pressure valve 17 into one of the cylinders of the internal combustion engine.

The free piston 14 continues its upward movement while its rear edge covers the spill port 25 and stops moving upwardly when the spill port 25 is brought into communication with the first pressure chamber 13*a*. At the same time, the fuel under high pressure in the first pressure chamber 13*a* is released therefrom through the spill port 25, the spill passage 22 and the collecting groove 24 into the outlet passage 30. At this time, the compression initiation timing and amount of compression decided by the displacement of the free piston 14 are sensed by the displacement sensing coil 41 which generates signals inputted to the control circuit 53.

Further rotation of the rotor 1 enables the aforesaid cycle to be repeated as the control circuit 53 generates successive control voltage signal upon receipt of signals from the displacement sensing coil 41 and the position sensor 52.

According to the embodiment shown and described hereinabove, the displacement sensing coil 41 for sensing the position of the free piston 14 is mounted in the axial passageway 13 in the rotor 1 to sense the amount of fuel fed for injection and the timing for initiating compression of the fuel to be injected, and the coil 41 generates signals which are taken out through the leads 43 on the holding rod 42, the terminals 44 and 48 and the conductors 49 to outside. This makes it possible to sense without any conducting trouble the amount of fuel to be injected in the second pressure chamber 13*b* in the rotor 1 and the timing of compression thereof. Also, the signals generated as the result of sensing are inputted to the control circuit 53 which controls the solenoid valves 28 and 29 through the valve drive circuit 34, so as to electrically control the amount of fuel to be injected and the timing for initiating compression thereof. The invention is capable of smoothly effecting fuel control without any trouble of conductors for transmitting a signal current from the displacement sensing coil 41.

The fuel injection pump according to the embodiment is intended for use with a diesel engine of 6-cylinder and 4-cycle for a passenger vehicle. Thus, the pump has six output passages 16. However, the invention is not limited to this specific number of the output passages 16 and any number of output passages may be provided to conform to the number of the cylinders of the engine for which the fuel injection pump according to the invention is used. Also, the rotor 1 has the rotational frequency which is one half that of the engine because the fuel injection pump is used with a 4-cycle engine. In the embodiment shown and described hereinabove, the displacement of the free piston 14 is about 3 mm when the free piston 14 has a diameter of 6 mm. This displacement was detected in the form of a change in inductance of the displacement sensing coil 41 with a high degree of reliability. The second pressure chamber 13*b* had a maximum pressure of 250 kgf/cm$^2$ at the fuel was injected.

From the foregoing description, it will be appreciated that the fuel injection pump for an internal combustion engine according to the invention is capable of sensing the amount of fuel to be injected in the second pressure chamber in the rotor and the timing for compressing same, to enable fuel injection to be satisfactorily effected.

What is claimed is:

1. A fuel injection pump for an internal combustion engine comprising:

a rotor located in a housing;

a free piston movably mounted in an axial bore in said rotor;

two pressure chambers defined by an inner wall surface of said axial bore in said rotor and said free piston;

two solenoid valves for supplying fuel to said two pressure chambers; and means for sensing an axial displacement of said free piston including:

a displacement sensing coil having its inductance varied as said free piston is displaced axially;

a holding rod for securing said displacement sensing coil thereto;

a thrust ring rotatably fitted between the inner wall surface of said axial bore in said rotor and an outer periphery of said holding rod; and a member secured to said rotor for keeping said thrust ring from moving axially.

2. A fuel injection pump for an internal combustion engine as claimed in claim 1, wherein said displacement sensing means further comprises:

conductors mounted into said holding rod; and an electric terminal formed at a fuel pressure adjusting section mounted at one end of said housing, said electric terminal being provided with means for preventing from its rotation;

wherein a signal generated by said displacement sensing coil is passed through said conductors and said electric terminal and taken out.

3. A fuel injection pump for an internal combustion engine as claimed in any one of claims 1 or 2, further comprising a control circuit receiving a signal inputted from said displacement sensing means, said control circuit being operative to control said solenoid valves to thereby control the amount of injected fuel and the timing of injection.

* * * * *